US006053335A

United States Patent [19]

Rutter

[11] Patent Number: 6,053,335

[45] Date of Patent: Apr. 25, 2000

[54] EXPANDABLE EGG SUPPORTING DEVICE

[76] Inventor: Margaret C. Rutter, 3 Purbeck Drive Lostock, Bolton, Lancashire BL6 4JF, United Kingdom

[21] Appl. No.: 09/026,419

[22] Filed: Feb. 19, 1998

[51] Int. Cl.[7] ..... A47F 7/00

[52] U.S. Cl. ..... 211/14

[58] Field of Search ..... 211/14, 85.4, 13.1, 211/15, 71.01; 248/127, 146, 160

[56] References Cited

U.S. PATENT DOCUMENTS

| | | |
|---|---|---|
| 168,690 | 1/1953 | Kalt . |
| 463,604 | 11/1991 | Iske . |
| 1,500,544 | 7/1924 | Brockley . |
| 1,720,115 | 7/1929 | Barnes . |
| 1,759,398 | 5/1930 | Hart . |
| 2,054,934 | 9/1936 | Graffenberger . |
| 2,108,594 | 2/1938 | Nelson . |
| 2,617,280 | 11/1952 | Anderson . |

*Primary Examiner*—Alvin Chin-Shue
*Assistant Examiner*—Sarah Purol

[57] ABSTRACT

A new expandable egg supporting device for stabilizing boiled eggs while removing their tops. The inventive device includes a base portion having a central aperture therethrough. The central aperture has a cylindrical flange extending upwardly therefrom. A plurality of flexible tabs are positioned circumferentially in a spaced relationship around a periphery of an upper end of the base portion. The flexible tabs are positioned for receiving an egg therewithin.

6 Claims, 2 Drawing Sheets

EXPANDABLE EGG SUPPORTING DEVICE

BACKGROUND OF THE INVENTION

1. Field of the Invention

The present invention relates to egg cups and more particularly pertains to a new expandable egg supporting device for stabilizing boiled eggs while removing their tops.

2. Description of the Prior Art

The use of egg cups is known in the prior art. More specifically, egg cups heretofore devised and utilized are known to consist basically of familiar, expected and obvious structural configurations, notwithstanding the myriad of designs encompassed by the crowded prior art which have been developed for the fulfillment of countless objectives and requirements.

Known prior art egg cups include U.S. Pat. No. 4,106,402 to Gevas; U.S. Pat. No. 4,617,860 to Blaylock; U.S. Pat. No. Des. 322,195 to Dacnen et al.; U.S. Pat. No. Des. 342,419 to Wilson; U.S. Pat. No. Des. 255,201 to Common; and U.S. Pat. No. Des. 309,845 to Pozzi.

While these devices fulfill their respective, particular objectives and requirements, the aforementioned patents do not disclose a new expandable egg supporting device. The inventive device includes a base portion having a central aperture therethrough. The central aperture has a cylindrical flange extending upwardly therefrom. A plurality of flexible tabs are positioned circumferentially in a spaced relationship around a periphery of an upper end of the base portion. The flexible tabs are positioned for receiving an egg therewithin.

In these respects, the expandable egg supporting device according to the present invention substantially departs from the conventional concepts and designs of the prior art, and in so doing provides an apparatus primarily developed for the purpose of stabilizing boiled eggs while removing their tops.

SUMMARY OF THE INVENTION

In view of the foregoing disadvantages inherent in the known types of egg cups now present in the prior art, the present invention provides a new expandable egg supporting device construction wherein the same can be utilized for stabilizing boiled eggs while removing their tops.

The general purpose of the present invention, which will be described subsequently in greater detail, is to provide a new expandable egg supporting device apparatus and method which has many of the advantages of the egg cups mentioned heretofore and many novel features that result in a new expandable egg supporting device which is not anticipated, rendered obvious, suggested, or even implied by any of the prior art egg cups, either alone or in any combination thereof.

To attain this, the present invention generally comprises a base portion having a closed circular upper end, an open circular lower end and a downwardly sloping cylindrical side wall. The closed upper end has a central aperture therethrough. The central aperture is in communication with the open lower end. The central aperture has a cylindrical flange extending upwardly therefrom. The closed lower end has an inner cylindrical ring positioned therein. A plurality of flexible tabs are positioned circumferentially in a spaced relationship around a periphery of the circular upper end of the base portion. The flexible tabs each have a rounded upper end. The flexible tabs are positioned for receiving an egg therewithin. The flexible tabs are expandable to accommodate eggs of various diameters therewithin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new expandable egg supporting device apparatus and method which has many of the advantages of the egg cups mentioned heretofore and many novel features that result in a new expandable egg supporting device which is not anticipated, rendered obvious, suggested, or even implied by any of the prior art egg cups, either alone or in any combination thereof.

It is another object of the present invention to provide a new expandable egg supporting device which may be easily and efficiently manufactured and marketed.

It is a further object of the present invention to provide a new expandable egg supporting device which is of a durable and reliable construction.

An even further object of the present invention is to provide a new expandable egg supporting device which is susceptible of a low cost of manufacture with regard to both materials and labor, and which accordingly is then susceptible of low prices of sale to the consuming public, thereby making such expandable egg supporting device economically available to the buying public.

Still yet another object of the present invention is to provide a new expandable egg supporting device which provides in the apparatuses and methods of the prior art some of the advantages thereof, while simultaneously overcoming sonic of the disadvantages normally associated therewith.

Still another object of the present invention is to provide a new expandable egg supporting device for stabilizing boiled eggs while removing their tops.

Yet another object of the present invention is to provide a new expandable egg supporting device which includes a base portion having a central aperture therethrough. The central aperture has a cylindrical flange extending upwardly therefrom. A plurality of flexible tabs are positioned circumferentially in a spaced relationship around a periphery of an upper end of the base portion. The flexible tabs are positioned for receiving an egg therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
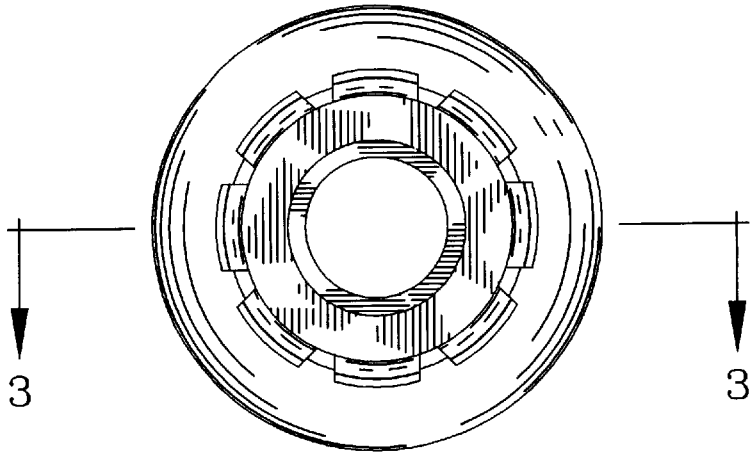
FIG. 2 is a top plan view of the present invention.
Figure 1:
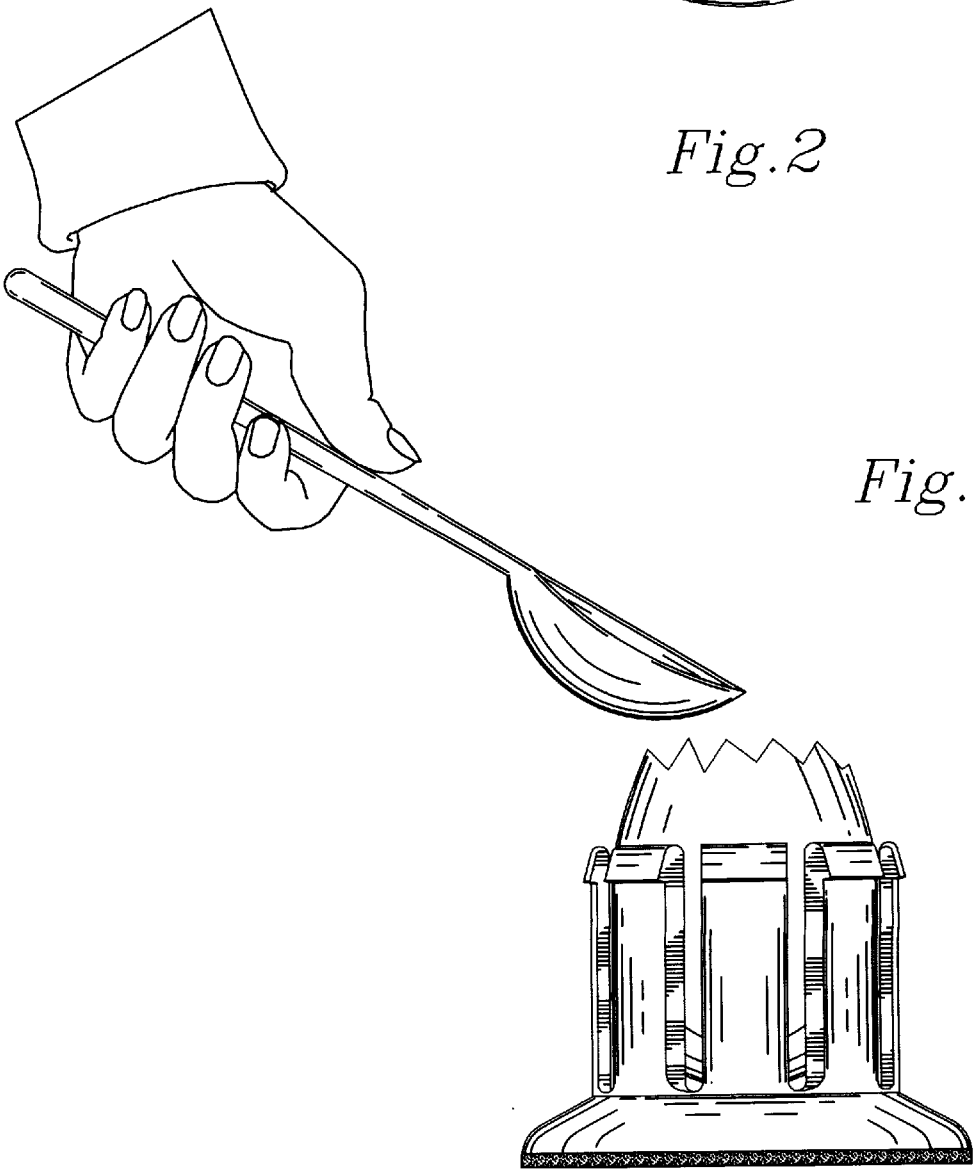
FIG. 1 is a side view of a new expandable egg supporting device according to the present invention illustrated in use.
Figure 4:
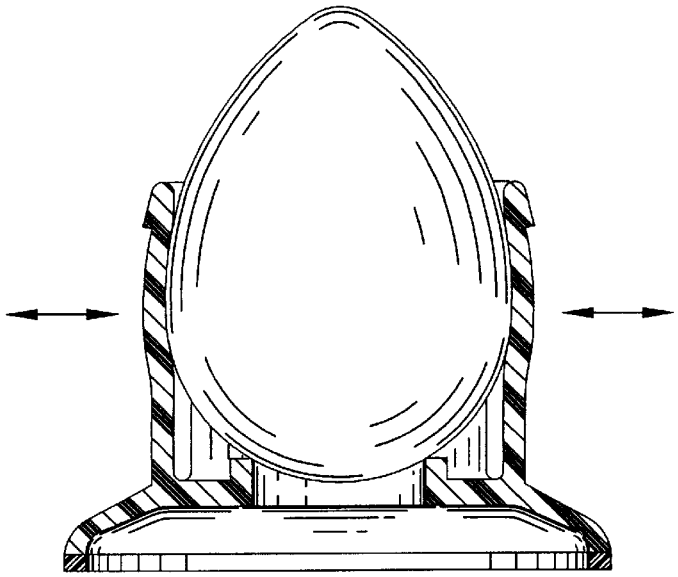
FIG. 4 is a cross-sectional view of the present invention illustrating the expandability thereof.
Figure 5:
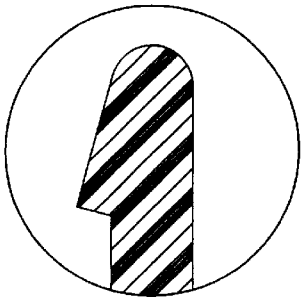
FIG. 5 is a sectional view of the present invention as taken from circle 5 of FIG. 3.
Figure 3:
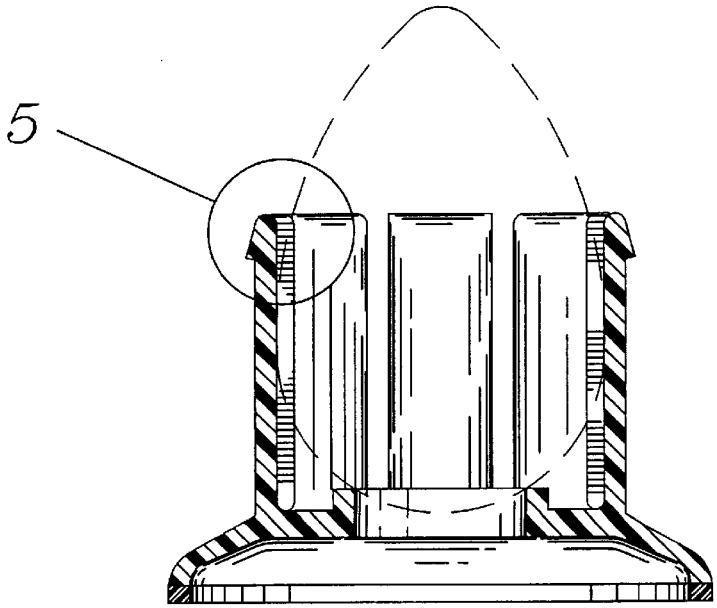
FIG. 3 is a cross-sectional view of the present invention as taken along line 3—3 of FIG. 2.

With reference now to the drawings, and in particular to FIGS. 1 through 5 thereof, a new expandable egg supporting device embodying the principles and concepts of the present invention and generally designated by the reference numeral 10 will be described.

As best illustrated in FIGS. 1 through 5, the expandable egg supporting device 10 comprises a base portion 12 having a closed circular upper end 14, an open circular lower end 16 and a downwardly sloping cylindrical side wall 18. The closed upper end 14 has a central aperture 20 therethrough. The central aperture 20 is in communication with the open lower end 16. The central aperture 20 has a cylindrical flange 22 extending upwardly therefrom. The closed lower end 16 has an inner cylindrical ring 24 positioned therein. The inner cylindrical ring 24 is provided so as to preclude slipping of the device 10 on a surface. Alternate configurations for the base portion 12 can be provided to enable useful purposes. The cylindrical side wall 18 could be wider in order to include indicia thereon or the side wall 18 could include a dished surface for the peeled shells of the egg to be retained therein.

A plurality of flexible tabs 26 are positioned circumferentially in a spaced relationship around a periphery of the circular upper end 14 of the base portion 12. The flexible tabs 26 each have a rounded upper end 28. The flexible tabs 26 are positioned for receiving an egg 30 therewithin. The flexible tabs 26 are expandable to accommodate eggs 30 of various diameters therewithin.

In use, the present invention would be an egg cup that would be used to stabilize a soft- or hard-boiled egg 30 while removing the top. The present invention is flexible to automatically fit any standard sized eggs 30. The present invention allows a person to quickly and easily crack open a boiled egg 30, and the unwanted top could be easily removed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expandable egg supporting device for stabilizing a boiled egg while removing a top portion of the egg comprising, in combination:

a base portion having a circular upper end, an open circular lower end and a downwardly sloping cylindrical side wall, the upper end having a central aperture therethrough, the central aperture being in communication with the open lower end, the central aperture having a cylindrical flange extending upwardly therefrom adapted for supporting a bottom portion of an egg, the lower end having a cylindrical ring extending outwardly from a lower peripheral edge of said lower end of said base portion, said cylindrical ring being adapted for resting against a support surface; and a plurality of flexible tabs positioned to extend upwardly in a spaced relationship to each other around an outer peripheral edge of the circular upper end of the base portion, the flexible tabs each having a rounded upper end and each of said tabs having a smooth interior face for abutting a surface of the egg and a substantially uniform orthogonal cross-section along a respective longitudinal axis of each of said tabs, the flexible tabs being oppositionally positioned around said outer perimeter edge of said upper end for receiving an egg between said flexible tabs, the flexible tabs being resiliently deformable such that a smooth interior face of each said tab generally conforms to a curvature of a medial surface portion of the eggs whereby said egg supporting device is adapted to accommodate eggs of various diameters.

2. An expandable egg supporting device for stabilizing boiled eggs while removing their tops comprising, in combination:

a base portion having a central aperture therethrough, the central aperture having a cylindrical flange extending upwardly therefrom said cylindrical flange being adapted for supporting a lower end of the egg; and a plurality of flexible tabs positioned circumferentially in a spaced relationship around a periphery of an upper end of the base portion, each of said tabs having a smooth interior face adapted for abutting a surface of the egg and a substantially uniform orthogonal cross-section along a respective longitudinal axis of each of said tabs the flexible tabs being positioned for receiving an egg therewithin.

3. The expandable egg supporting device as set forth in claim 2 wherein the base portion has an inner cylindrical ring positioned within an open lower end thereof.

4. The expandable egg supporting device as set forth in claim 2 wherein the flexible tabs each have a rounded upper end.

5. The expandable egg supporting device as set forth in claim 2 wherein the flexible tabs are resiliently deformable such that the smooth interior face of each said tab generally conforms to a curvature of a medial surface portion of the egg, whereby said egg supporting device is adapted to accommodate eggs of various diameters.

6. The expandable egg supporting device as set forth in claim 2 wherein the base further includes a cylindrical ring extending outwardly from a lower peripheral edge of said lower end of said base portion, said cylindrical ring being adapted for resting against a support surface.

* * * * *